United States Patent [19]

Bramer

[11] Patent Number: 4,480,455

[45] Date of Patent: Nov. 6, 1984

[54] METHOD AND DEVICE FOR ROLLING TUBE TO A SMALLER DIAMETER

[75] Inventor: Albert J. Bramer, Vriezenveen, Netherlands

[73] Assignee: M and M Technics AG, Switzerland

[21] Appl. No.: 378,183

[22] Filed: May 14, 1982

Related U.S. Application Data

[63] Continuation of Ser. No. 142,992, Apr. 23, 1980, abandoned.

[30] Foreign Application Priority Data

Apr. 24, 1979 [NL] Netherlands ..... 7903234

[51] Int. Cl.[3] ..... B21B 19/02

[52] U.S. Cl. ..... 72/95; 72/69

[58] Field of Search ..... 72/69, 78, 81, 95, 96, 72/100, 101, 120

[56] References Cited

U.S. PATENT DOCUMENTS

| | | | |
|---|---|---|---|
| 374,703 | 12/1887 | Ritchie | 72/100 |
| 1,141,427 | 6/1915 | Simpkins | 72/95 |
| 1,301,220 | 4/1919 | Brinkman | 72/69 |
| 2,176,412 | 10/1939 | Assel | 72/100 |
| 2,410,052 | 10/1946 | Dewey | 72/120 |
| 2,503,464 | 4/1950 | Bannister | 72/69 |
| 3,465,563 | 9/1969 | Verdickt | 72/96 |

FOREIGN PATENT DOCUMENTS

| | | | |
|---|---|---|---|
| 17581 | 9/1963 | Japan | 72/95 |
| 1440590 | 6/1976 | United Kingdom | 72/85 |

*Primary Examiner*—Lowell A. Larson

*Attorney, Agent, or Firm*—Andrus, Sceales, Starke & Sawall

[57] ABSTRACT

A method and device for rolling tube to a smaller diameter, with which at least one area of the outside of the tube is brought into contact with at least one roll rotatable around its axis, whereby this roll and the tube are brought into a relative movement with respect to each other. The contact surface of the roll and tube, considered between two planes spaced in a longitudinal direction of the tube, lies at an angle to the longitudinal axis of the tube.

The contact surfaces of the rotatable rolls with the deformed tube follow one or more spaced spirals with conically rolled tube or one or more helical lines with cylindrical rolled tube. The position of the effective roll surfaces is adjustable with respect to the longitudinal axis and the transverse axis of the tube, and the contact area with the one or more rolls is heated to the roll temperature before the rolling.

6 Claims, 3 Drawing Figures

METHOD AND DEVICE FOR ROLLING TUBE TO A SMALLER DIAMETER

This application is a continuation of application Ser. No. 142,992, filed Apr. 23, 1980, now abandoned.

BACKGROUND OF THE INVENTION

The invention relates to a method for rolling a tube to a smaller diameter, in which at least one area of the outside of the tube is brought into contact with at least one roll that is rotatable around its axis, whereby said roll and the tube are brought into a relative movement with respect to another. The contact surface of the roll and the tube, considered between two planes spaced in the longitudinal direction of the tube, lies at an angle, to the longitudinal axis of the tube.

A method of this type is known from the U.S. Pat. No. 3,354,682, with which one produces a truncated pyramid shaped tube by means of an internal, truncated pyramid shaped mandrel placed in the cylindrical starting tube and two eccentric rolls, of which the rotation axis is perpendicular to the longitudinal direction of the tube. The roll surfaces comprise a triangular groove which delimit together the square cross section. In addition to being eccentric, the rolls also comprise an interrupted roll surface, so that the total roll length is limited to the effective developed length of the circumference of the roll.

This has the objection, that for tubes of different size and diameter, other rolls and other mandrels are required which takes much labour, makes a large investment necessary in rolls and mandrels, and makes an economic operation difficult.

SUMMARY OF THE INVENTION

The object of the invention is overcoming these objections and providing a method and device with which very large tube length of different start and end diameter can be rolled, without the necessity of using internal mandrels or making the interchange of rolls necessary.

This object is reached according to the invention, in that the contact surfaces of the rotatable rolls with the deformed tube follow one or more spaced spirals with a conical rolled tube or one or more helical lines with cylindrical rolled tube.

By application of the invention it is provided, that tube of largely differing diameter can be rolled by means of a limited number of rolls to very largely differing length profiles, whereas the surface of the tube stays closed so that this tube offers a very good resistance to corrosion. Furthermore a great many types of tube can be rolled, such as for example a tube which is conical over its complete length, or a tube which comprises a succeeding number of lengths with a constant cross section, which are mutually connected by shorter conical parts.

DESCRIPTION OF THE PRIOR ART

Substantially conical tubes, such as for example light or ships masts, are generally known. In British Pat. No. 1,099,182 for example, a conical tapering metal ships mast is described, which is produced by rolling a metal plate and folding this one in the longitudinal direction of the mast. The slot of the profile formed however necessitates a seal.

Also stepped tapering light masts are known, of which the tube shaped parts of differing diameter are welded together by means of reducers.

These known methods have several objections apart of the already indicated necessity of the extra operation with the above known methods, such as closing off by welding or sealing. With the light poles produced according to these known methods the risk is present, that the welding seams corrode and also therefore shorten the life of the masts.

DESCRIPTION OF THE DRAWINGS

The invention will now further be elucidated referring to the accompanying drawing of some exemplified embodiments.

DESCRIPTION OF THE PREFERRED EMBODIMENTS

Figure 1:
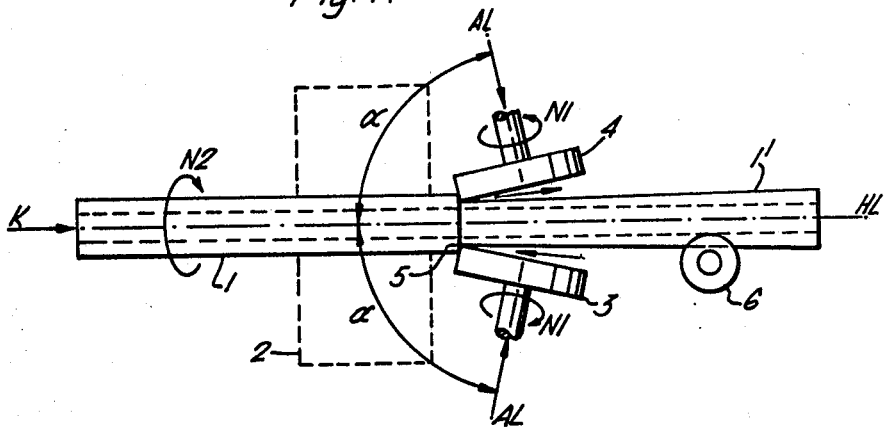
FIG. 1 shows schematically a side view of a device for performing the method according to the invention.

According to the drawing as starting material a piece of round cylindrical tube 1 is applied, preferably of steel, which is rolled in the device without internal mandrel to a conical tube 1', of which the diameter is smaller than that one of the starting tube 1.

Figure 2:
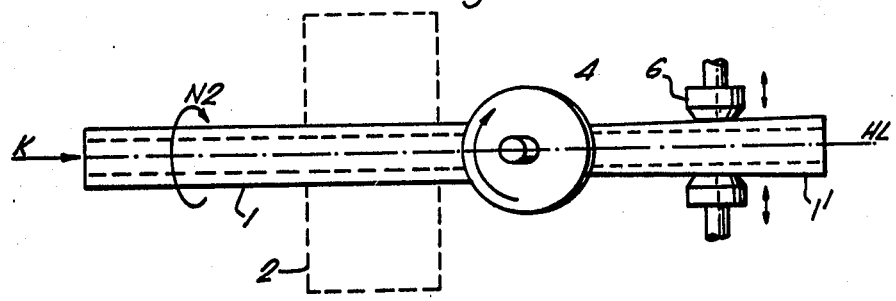
FIG. 2 shows a plan view of the device according to FIG. 1.

The tube 1 is led through a heating unit 2, with which the tube is brought to the roll temperature. As shown in FIGS. 1 and 2, heating unit 2 heats a limited, axial length section of tube as the tube moves through the heating unit. After leaving the heating unit 2 two cylindrical, disk shaped, rotary driven rolls 3, 4 contact the tube 1, which rolls have been mounted at both sides of the tube. The axis of rotation A1 of the rolls each make an angle $\alpha$ with the longitudinal axis H1 of the tube, which angle $\alpha$ is in this embodiment smaller than 90°. The contact surfaces of the rolls 3, 4 with the outer circumference of the tube 1 are preferably each on a separate helical line with cylindrical rolled tube or on a spaced spiral with conical rolled tube, so that each of the rolls brings about a part of the total deformation. In the drawing it is apparent that from the starting diameter the rolls have already moved over some distance symmetrically toward each other, as a result of which a shoulder 5 has formed, which is rolled out. The rolls 3, 4 each rotate with a number of revolutions N1 around their axes A1, so that the tube 1, 1' rotates with a number of revolutions N2 that becomes gradually smaller, after the rolls 3, 4 having moved closer to the longitudinal direction H1. For the support of the rolled out tube 1' a set of conical support rolls 6 is arranged.

Figure 3:
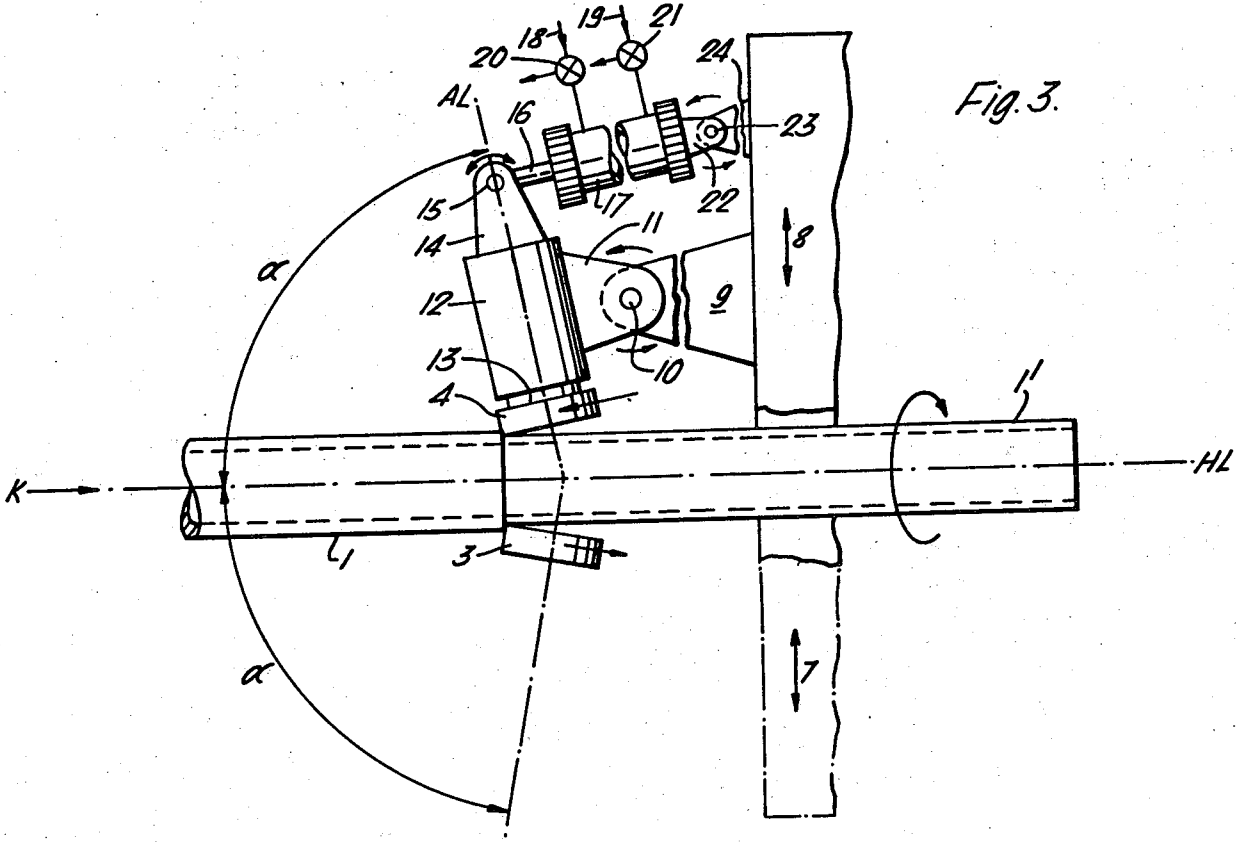
FIG. 3 shows a schematic side view of another embodiment of the device according to FIG. 1, and more specifically a device for adjusting the rolls.

In FIG. 3 an embodiment is shown of the adjusting devices for the rolls 3, 4 which are symmetrical so that only one of these adjusting devices is shown. The rolls 3, 4 are amounted on the carriers 7, 8 which are movable to and from the longitudinal axis H1 by means of (not shown) displacement means. The carrier 8 has been provided with a support 9 which has been provided at its end with a pivot shaft 10, around which also a carrier 11 can pivot a roll drive motor 12. This roll motor 12, which is for example electrically or hydraulically driven, carries at its end turned to the longitudinal axis the roll 4 by means of the shaft 13. The roll motor 12 has been provided at its other end with a support 14 that is provided at its end with a pivot shaft 15 on which the piston rod 16 of a piston-cylinder unit 17 is mounted. This unit can be controlled by means of the supply and exhaust lines 18, 19 and the valves 20, 21 in such a way, that the piston rod 16 is extended further or less far. At its other end the piston-cylinder unit 17 is also fastened to the carrier 8 by means of a pivot connection 22, 23, 24. By the operation of the piston-cylinder unit the position of the roll 4 and thereby the angle $\alpha$ can be changed, whereas by the displacement of the slide 8 the rolls can be moved closer to the longitudinal axis H1 or further away therefrom.

As shown in FIG. 3, a force K is applied to tube 1 to move the tube through rolls 3, 4.

Instead of giving a rotary drive to the rolls 3, 4 also the tube 1 can be rotary driven, whereas the rolls 3, 4 are then freely rotatable around their axes; in this case there is also applied a pull force K on the tube 1.

Although with the device according to the invention round tube, preferably from steel, is processed to conical tube or cylindrical tube with conical parts, such as adapted for use as light mast, it is evident that also other metals and/or other materials, such as for example synthetic materials could be processed.

The invention is not limited to the shown and/or described embodiments but covers all variations thereof.

The embodiments of the inventions in which an exclusive property or privilige is claimed are defined as follows:

1. A method of rolling an elongated round tube to a conical mast without the use of an internal mandrel comprising the steps of:

heating a section of the tube of limited axial length at a first location;

contacting the exterior of the heated section of the tube, at a second location, with the forming surface of a pair of rolls at circumferentially spaced points about the tube, said rolls being driven about axes lying in a common plane containing the axis of the tube and diverging toward the first location, the contact of tube and rolls providing circumferential movement of the tube with respect to the rolls for causing the forming surface to roll the tube to a smaller diameter in a conical configuration;

moving the tube longitudinally through the rolls from the first location past the second location, said longitudinal movement being provided to the tube independently of the action of the rolls; and moving the rolls inwardly toward the tube solely normal to the axis of the tube as the tube is longitudinally moved through the rolls to form the conical mast.

2. The method according to claim 1 further defined as including the step of altering the angle of divergence of the roll axes.

3. The method according to claim 1 further defined as one for rolling steel tube.

4. An apparatus for rolling an elongated round tube to a conical mast without the use of an internal mandrel comprising:

heating means located at a first location in said apparatus for heating a section of the tube of limited axial length;

a pair of rolls located at a second location in said apparatus, said rolls having forming surfaces for contacting the exterior of the heated section of the tube at circumferentially spaced points about the tube, said rolls having axes of rotation lying in a common plane receiving the axis of the tube, the axes of said rolls diverging in the direction towards the first location;

drive means for rotating said rolls about said axes, the contact of the rotating rolls with the exterior of the tube providing circumferential movement of the tube with respect to the rolls for causing said forming surfaces to roll the tube to a smaller diameter in a conical configuration;

means moving the tube longitudinally through the apparatus from the first location past the second location independently of the rotating action of said rolls; and means moving the rolls inwardly toward the tube solely normal to the axis of the tube to form the conical mast from the tube.

5. The apparatus according to claim 4 including support means for the tube in said apparatus.

6. The apparatus according to claim 4 including means operatively associated with said rolls for altering the angle of divergence of the axes of said rolls.

* * * * *